US010058832B2

(12) United States Patent
Hoefken

(10) Patent No.: US 10,058,832 B2
(45) Date of Patent: Aug. 28, 2018

(54) DEVICE FOR CIRCULATING A LIQUID RECEIVED IN A CONTAINER HAVING A STIRRING BODY WITH AN APERTURE PROVIDED ON THE STIRRING BODY

(71) Applicant: INVENT UMWELT- UND VERFAHRENSTECHNIK AG, Erlangen (DE)

(72) Inventor: Marcus Hoefken, Erlangen (DE)

(73) Assignee: INVENT UMWELT- UND VERFAHRENSTECHNIK AG, Erlangen (DE)

( * ) Notice: Subject to any disclaimer, the term of this patent is extended or adjusted under 35 U.S.C. 154(b) by 173 days.

(21) Appl. No.: 15/104,791

(22) PCT Filed: Oct. 27, 2014

(86) PCT No.: PCT/EP2014/072937
§ 371 (c)(1),
(2) Date: Jun. 15, 2016

(87) PCT Pub. No.: WO2015/086212
PCT Pub. Date: Jun. 18, 2015

(65) Prior Publication Data

US 2016/0339401 A1 Nov. 24, 2016

(30) Foreign Application Priority Data

Dec. 11, 2013 (DE) ..... 10 2013 225 659

(51) Int. Cl.
*B01F 7/00* (2006.01)
*B01F 7/16* (2006.01)

(52) U.S. Cl.
CPC ..... *B01F 7/0055* (2013.01); *B01F 7/00541* (2013.01)

(58) Field of Classification Search
CPC ..... B01F 7/0055; B01F 7/00541; B01F 15/00922; B01F 7/00033; B01F 7/0015;
(Continued)

(56) References Cited

U.S. PATENT DOCUMENTS 4,421,696 A * 12/1983 Graue ..... B01F 3/04241 261/123
4,938,899 A * 7/1990 Oros ..... B01F 3/04262 261/123
(Continued)

FOREIGN PATENT DOCUMENTS

DE 3519520 A1 * 12/1986 ..... B01F 3/04539
DE 3603466 A1 * 8/1987 ..... B01F 3/04539
(Continued)

OTHER PUBLICATIONS

PCT/ISA/237 "Written Opinion of the International Searching Authority for International Application No. PCT/EP2014/072937," dated Jan. 27, 2015.
(Continued)

*Primary Examiner* — Charles Cooley
(74) *Attorney, Agent, or Firm* — Manabu Kanesaka

(57) ABSTRACT

A device for circulating a liquid received in a container, in particular for circulating wastewater received in a tank, has a hyperboloid-like or truncated cone-like stirring body mounted on a vertical shaft, wherein a plurality of transport ribs extending from the peripheral edge in the direction of the shaft are provided on an outer side of the stirring body, a centerline between two adjacent transport ribs is defined by points of equal minimum distance from each crest line of the two adjacent transport ribs, an aperture is provided in the stirring body between the two transport ribs, and an aperture area delimited by the edge of the aperture has a geometric center of gravity. The geometric center of gravity of the
(Continued)

aperture area is disposed in a region between the centerline and the crest line of one of the two transport ribs.

9 Claims, 4 Drawing Sheets

(58) Field of Classification Search
CPC ..... B01F 2215/0052; B01F 7/00725; B21D 53/267
USPC ..... 416/231 R, 231 A; 366/331
See application file for complete search history.

(56) References Cited

U.S. PATENT DOCUMENTS 5,100,295 A * 3/1992 Madden ..... F04D 29/2277 415/143
7,784,769 B2 * 8/2010 Hoefken ..... B01F 3/04773 210/150
D665,047 S * 8/2012 Hofken ..... B01F 7/00541 D23/207
8,434,744 B2 * 5/2013 Hoefken ..... B01F 3/04531 261/93
8,459,863 B2 * 6/2013 Hoefken ..... B01F 3/04539 366/331
8,651,732 B2 * 2/2014 Hoefken ..... B01F 3/04531 366/295
8,905,706 B2 * 12/2014 Bills ..... F03D 1/0633 415/72
9,050,567 B2 * 6/2015 Hoefken ..... B01F 7/00541
D733,839 S * 7/2015 Hoefken ..... D23/200
D735,291 S * 7/2015 Hoefken ..... D23/200
9,556,047 B2 * 1/2017 Hoefken ..... B01F 3/0412
2005/0161838 A1 * 7/2005 Hofken ..... B01F 3/04531 261/93
2009/0127213 A1 * 5/2009 Hoefken ..... B01F 3/04773 210/800
2010/0182869 A1 * 7/2010 Hoefken ..... B01F 3/04531 366/343
2010/0196165 A1 * 8/2010 Hoefken ..... B01F 3/04531 416/223 R
2010/0201008 A1 * 8/2010 Hoefken ..... B01F 3/04531 261/93
2011/0003646 A1 * 1/2011 Hoefken ..... B01F 3/04539 464/178
2012/0307587 A1 * 12/2012 Hoefken ..... B01F 7/00541 366/331
2013/0093106 A1 * 4/2013 Hoefken ..... B01F 3/0412 261/64.1
2016/0339401 A1 * 11/2016 Hoefken ..... B01F 7/0055
2017/0001156 A1 * 1/2017 Hoefken ..... B01F 7/00541
2017/0021313 A1 * 1/2017 Hoefken ..... B01F 7/00541
2017/0065945 A1 * 3/2017 Hoefken ..... B01F 7/00541

FOREIGN PATENT DOCUMENTS

DE 9106639 U1 * 9/1991 ..... B01F 3/04531
DE 4218027 A1 * 12/1992 ..... B01F 3/04531
JP 2006051418 A * 2/2006 ..... B01F 7/00541
JP 2006061780 A * 3/2006 ..... B01F 7/00541
JP 2007090218 A * 4/2007 ..... B01F 7/00541
SU 1007714 A 3/1983
WO 2006/108538 A1 10/2006

OTHER PUBLICATIONS

PCT/ISA/210, "International Search Report for International Application No. PCT/EP2014/072937", dated Jan. 14, 2015.
PCT/ISA/237, "Written Opinion of the International Searching Authority for International Application No. PCT/EP2014/072937.", dated Jan. 2015.

* cited by examiner

DEVICE FOR CIRCULATING A LIQUID RECEIVED IN A CONTAINER HAVING A STIRRING BODY WITH AN APERTURE PROVIDED ON THE STIRRING BODY

RELATED APPLICATIONS

The present application is National Phase of International Application No. PCT/EP2014/072937 filed Oct. 27, 2014, and claims priority from German Application No. 10 2013 225 659.0, filed Dec. 11, 2013, the disclosure of which is hereby incorporated by reference herein in its entirety.

BACKGROUND OF THE INVENTION

Field of the Invention

The invention relates to a device for circulating a liquid received in a container, in particular for circulating waste-water received in a tank.

Description of the Related Art

A device of this type is known from WO 2006/108538 A1. With the known device it is possible to circulate the waste-water received in the tank with a relatively low consumption of electrical energy. Nevertheless, there is a need to improve the efficiency of such a device further still, so that more energy can be saved.

A device of this type is known from WO 2006/108538 A1. With the known device it is possible to circulate the waste-water received in the tank with a relatively low consumption of electrical energy. Nevertheless, there is a need to improve the efficiency of such a device further still, so that more energy can be saved.

SUMMARY OF THE INVENTION

The object of the invention is to specify a device with which a liquid received in a container can be circulated with improved efficiency.

This object is achieved by the features of one aspect of the invention. Expedient embodiments of the invention will emerge from the features of the other aspects of the invention.

In accordance with the invention it is proposed for the geometric centre of gravity of the aperture area to be disposed in a region between the centerline and one of the two transport ribs. It has surprisingly been found that, as a result of the shifting of the aperture area with respect to the centerline into the vicinity of one of the two transport ribs as proposed in accordance with the invention, the efficiency of the device can be significantly increased.

In the context of the present invention, the term "aperture area" is understood to mean a flat surface resulting from projection on a plane extending perpendicularly to the surface normal to the aperture area, said surface normal extending through the centre of gravity.

The geometric centre of gravity of the aperture area corresponds to the centre of mass of a physical body which corresponds to the aperture area, consists of homogeneous material and has the same thickness everywhere. It can therefore be determined by way of example purely mechanically by balancing. However, the geometric centre of gravity of the aperture area can also be calculated using mathematical methods that are known in general. By way of example, the aperture area can be described approximately by a polygon and a mathematical method for calculating the centre of gravity of a polygon can be used to calculate the geometric centre of gravity. In addition, it is also possible to determine the geometric centre of gravity of the aperture area by integration.

The term "upper side of the stirring body" is understood to mean the side formed approximately convexly or in raised manner. By contrast, an "underside of the stirring body" has an approximately concave form or a form forming a depression.

In accordance with an advantageous embodiment the transport ribs each have a curvature directed towards the shaft in the radial direction. In other words, the transport ribs extend in a slanting manner in the region of a peripheral edge and then bend in the radial direction. The efficiency of the stirring body can be improved as a result.

The aperture area extends substantially in the radial direction. It has a first end in the vicinity of the shaft and a second end in the vicinity of the peripheral edge. The aperture area can have a greater width at the second end than at the first end. In other words, the aperture area, which is elongate in the radial direction, advantageously becomes larger towards the peripheral edge.

In accordance with a further embodiment a height of the transport ribs increases from the peripheral edge to approximately the first end of the adjacent aperture area. The height of the transport ribs then decreases again for example from the first end of the adjacent aperture area in the direction of the shaft. A maximum of the height of the transport ribs can also lie between the first and the second end. In this case it lies preferably closer to the first end than to the second end. It has been found that in particular the embodiment of the transport ribs in combination with the adjacent position of the aperture areas leads to a further efficiency increase.

The aperture area is advantageously delimited on one of its long sides by a transport rib. This one long side of the aperture area is advantageously delimited adjacently to or bordering on the side of the transport rib that is convexly curved as considered from the upper side of the stirring body.

In accordance with a particularly advantageous embodiment the transport rib is inclined towards the aperture area of the adjacent or bordering aperture. The transport rib can form an angle $\alpha$ of approximately 90° with the upper side of the stirring body in the region of the peripheral edge. The angle $\alpha$ advantageously decreases in the direction of the aperture area to a value in the range from 60 to 87°, such that the transport rib is inclined towards the aperture area. This surprisingly results in a further increase in efficiency.

In accordance with a further embodiment of the invention a ratio between a lateral surface of the stirring body and a total aperture area of all apertures lies in the range from 10:1 to 10:2. The term "lateral surface of the stirring body" is understood to mean the surface of the upper side of the stirring body, the surfaces formed by the transport ribs being omitted.

In accordance with an advantageous embodiment of the invention the center of gravity of the aperture areas are distanced from one another approximately at the same angle. A symmetry of the stirring body is advantageously defined by an n-fold axis of rotation, wherein n is an integer from 6 to 12. In other words, the stirring body according to the invention advantageously has six to twelve apertures.

In accordance with a further particularly advantageous embodiment the stirring body is formed from structurally identical segments, which are interconnected along joining zones extending from the peripheral edge to a centrally arranged connector piece. This simplifies the production of the stirring body significantly.

It has proven to be particularly advantageous to form each segment such that the transport rib is arranged in the region of a joining zone and the aperture is delimited in part by the transport rib.

In accordance with a further advantageous embodiment the apertures are arranged in the region of a radially inner half of the stirring body. In other words, the aperture extends via its second end at most over half of the radius of the stirring body.

An exemplary embodiment of the invention will be explained in greater detail hereinafter on the basis of the drawings, in which:

DESCRIPTION OF THE PREFERRED EMBODIMENTS

Figure 1:
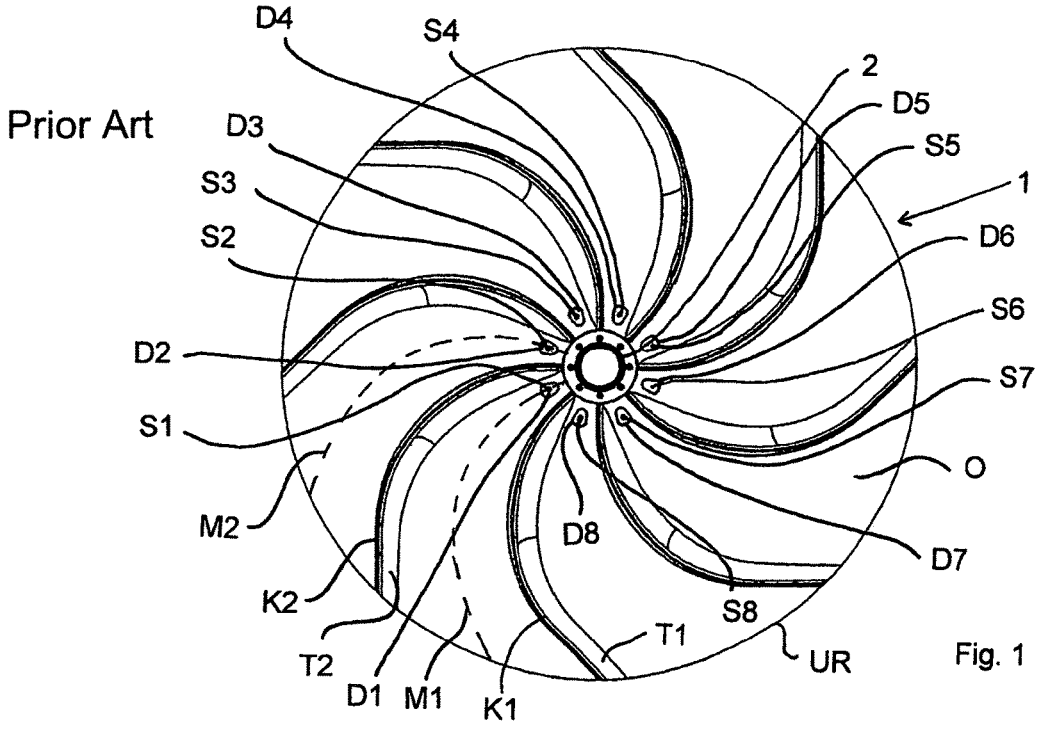
FIG. 1 shows a plan view of a stirring body according to the prior art.

FIG. 1 shows a plan view of a stirring body according to the prior art denoted here in general by the reference sign 1. The stirring body has a substantially hyperboloid-like form (not visible here). A central connector piece 2 serves for connection to a shaft (not shown here). A plurality of transport ribs T1 to T8 extending from the peripheral edge UR in the direction of the shaft or in the direction of the connector piece 2 are provided on the upper side O of the stirring body 1. Each of the transport ribs T1 to T8 has a crest line K1 to K8. Two adjacent crest lines, for example K1 and K2, define therebetween a centerline M1. The centerline M1 is given by points of equal minimum distance to each of the crest lines K1 and K2 of the adjacent transport ribs T1 and T2.

An aperture D1 to D8 is provided between each two transport ribs T1 to T8, and only one aperture is provided between two transport ribs adjacent to each other. An aperture area of each of the apertures D1 to D8 has a geometric centre of gravity S1 to S8. The geometric center of gravity S1 to S8 lies, in the case of the stirring body 1 according to the prior art, on the corresponding centerline, respectively, of which only M1 and M2 are shown here by way of example.

FIGS. 2 to 6 show a stirring body 1 according to the invention. As is clear in particular from FIGS. 2, 3 and 6, the apertures D1 to D8 are each arranged here in a manner bordering the transport ribs T1 to T8. The geometric centers of gravity, of which only the centers of gravity S1 and S8 have been shown here by way of example, of the apertures D1 to D8 lie, in the case of the stirring body 1 according to the invention, in a region between the centerlines M1, M8 and the crest lines K1, K8 of the adjacent transport ribs T1, T8.

The centers of gravity S1, S8 advantageously are disposed approximately centrally between the respective centerlines M1, M8 and the adjacent transport ribs T1, T8. The geometric centers of gravity S1, S8 can lie in particular in the central region of a straight path W connecting the centerlines M1, M8 to the adjacent transport rib T1, T8 (see FIG. 2). The "central region" of the path W is understood to mean a region that extends from the end of a first third to the start of a third third of the path W, i.e. the region thus comprises the second third of the path W. In the practical embodiment the centers of gravity S1, S8 lie at least at 1 cm, preferably at least at 2 cm, on the path W next to the centreline in the peripheral direction.

Figure 4:
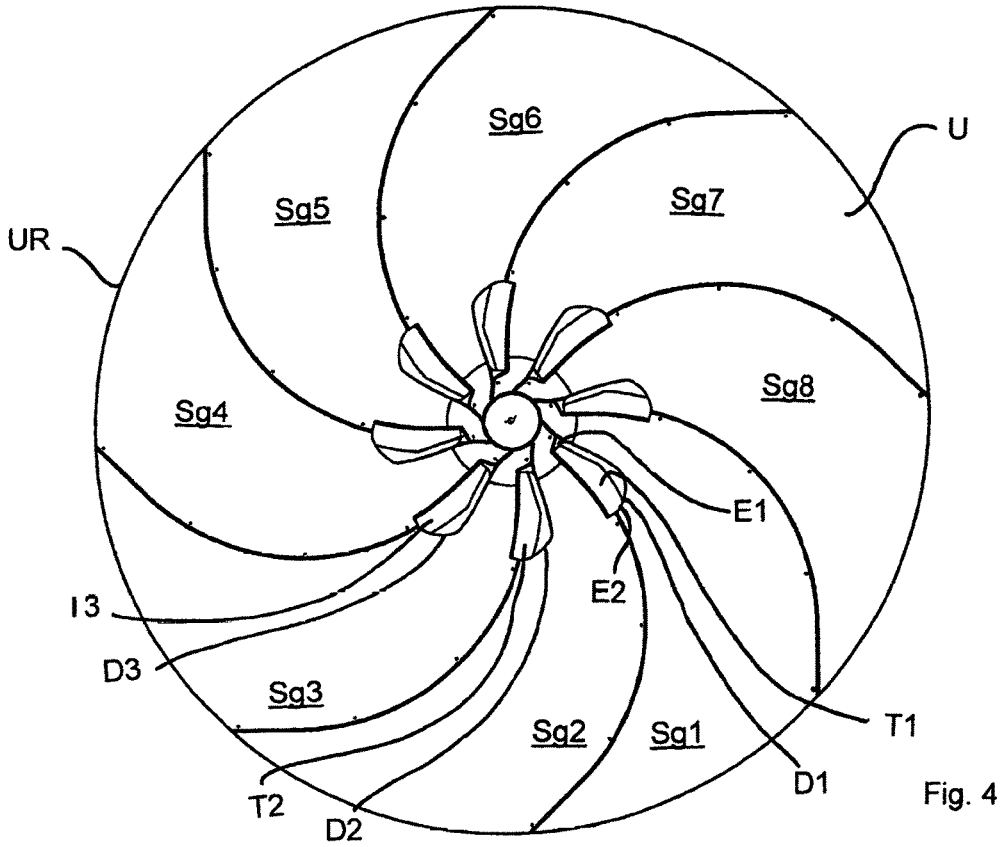
FIG. 4 shows a view from beneath according to FIG. 2.
Figure 5:
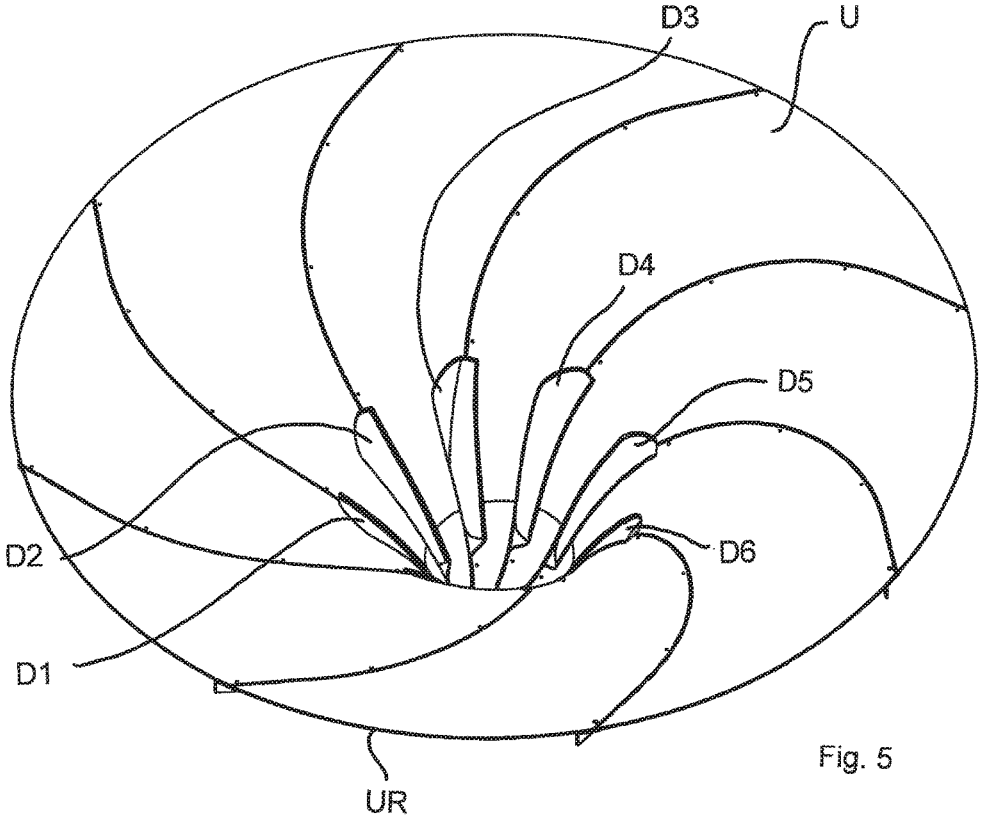
FIG. 5 shows a perspective view from below according to FIG. 2.
Figure 6:
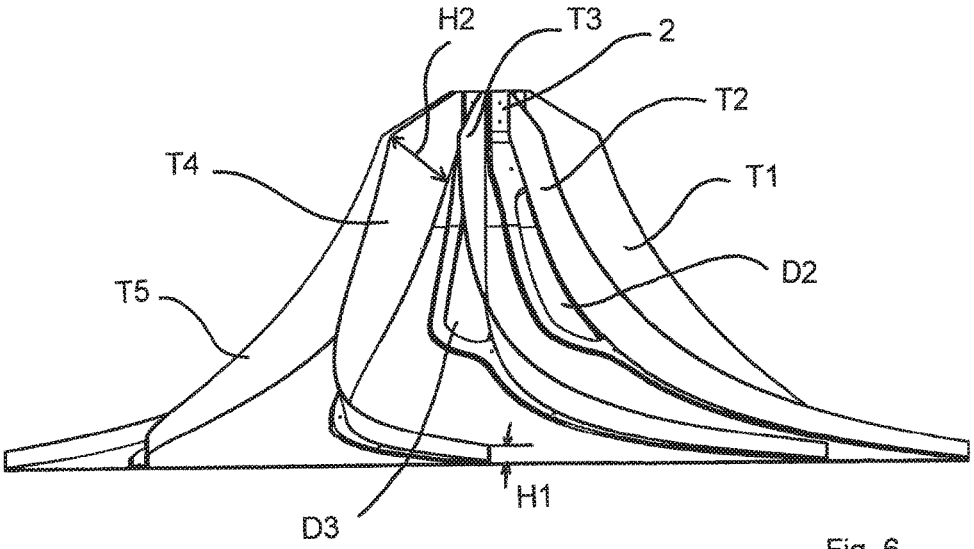
FIG. 6 shows a side view according to FIG. 2

Each aperture D1 to D8 has a first end E1 in the vicinity of the connector piece 2 or a shaft mounted thereon and a second end E2 in the vicinity of the peripheral edge UR (see FIG. 4). The aperture D1 to D8 has an elongate form in the radial direction. An area content of the aperture area increases towards the peripheral edge UR. The aperture area is delimited on one of its long sides by a transport rib T1 to T8. In a plan view of the upper side O, said one long side of the aperture area is advantageously delimited by the convexly curved side of the transport rib T1 to T8.

Each transport rib T1 to T8 has, in the region of the peripheral edge UR, a minimum height H1 and in the region of the aperture D1 to D8 a maximum height H2. A ratio H1/H2 lies in the range 1/5 to 1/100, preferably in the range 1/5 to 1/20. The maximum height H2 lies advantageously at the first end E1 of the aperture D1 to D8. It can also lie between the first and the second end E2 of the aperture D1 to D8. A normal of the maximum height to the aperture area D1 to D8 expediently lies at a distance of at most 15 cm from the first end E1. The maximum height H2 decreases again from the apertures D1 to D8 in the direction of the connector piece 2.

The transport ribs T1 to T8 extend at least in the region of the peripheral edge UR substantially perpendicularly from the upper side O, i.e. they form an angle $\alpha$ of approximately 90° with the upper side O. The angle $\alpha$ decreases with increasing distance from the peripheral edge UR, such that the transport rib T1 to T8 is inclined in the direction towards the adjacent aperture D1 to D8. In the region of the aperture D1 to D8, the angle $\alpha$ is expediently less than 90°. It lies there in a range from 60 to 87°. On the whole, the angle $\alpha$ can thus lie in a range from 60 to 90°. The partial overlap of the apertures D1 to D8 by the obliquely inclined transport ribs T1 to T8 is visible in particular from FIGS. 3 and 4. In FIG. 4 an underside opposite the upper side O of the stirring body 1 is denoted by reference sign U.

The stirring body 1 is constructed symmetrically in the present exemplary embodiment. Here, it has an eight-fold axis of rotation. It is of course also possible for the stirring body 1 to have an n-fold axis of rotation, wherein n for example is an integer from 6 to 12.

Figure 3:
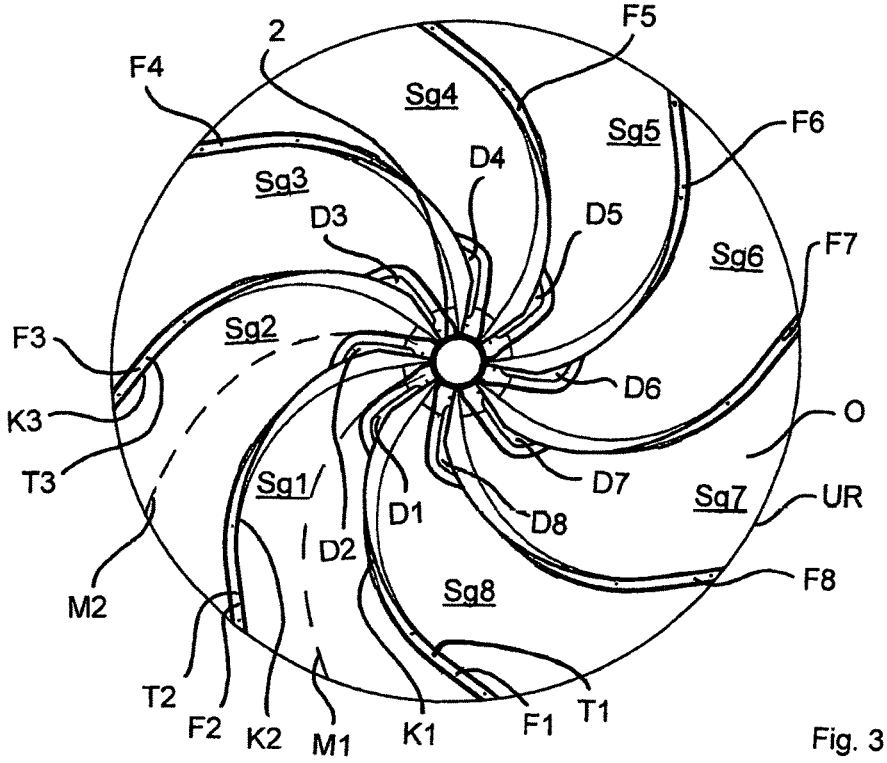
FIG. 3 shows a plan view according to FIG. 2.
Figure 2:
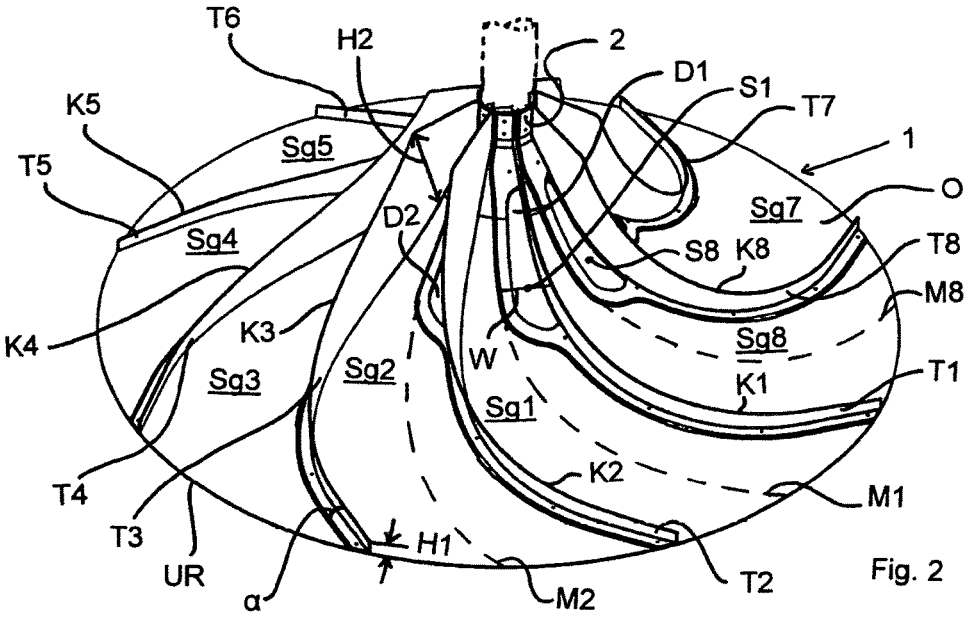
FIG. 2 shows a perspective view of a stirring body according to the invention.

The stirring body 1 can be produced advantageously from a plurality of structurally identical segments Sg1 to Sg8 (see FIGS. 2 to 4). In this case the segments Sg1 to Sg8 are interconnected along joining zones F1 to F8 (see FIG. 3). A profile of the joining zones F1 to F8 corresponds substantially to the curved profile of the transport ribs T1 to T8.

Figure 7:
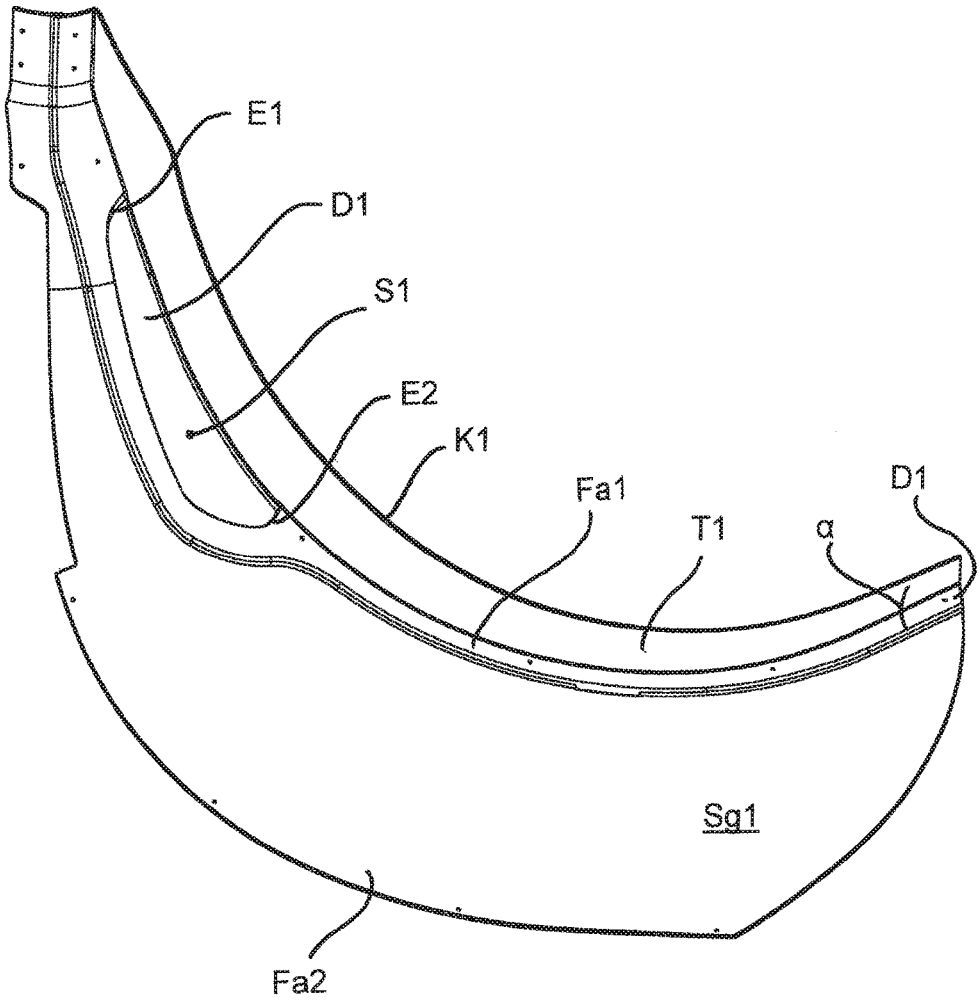
FIG. 7 shows a perspective view of a segment.

FIG. 7 shows, by way of example, a perspective view of a first segment Sg1. The first segment Sg1 has a first joining portion Fa1 on one of its long edges and a second joining portion Fa2 on its other long edge. The first joining portion Fa1 is provided with a first joining profile P1, which is formed here in the manner of a step. The first transport rib T1 extends from the first joining profile P1 at an angle $\alpha$.

The first segment Sg1 has, in the region of the second joining portion Fa2, generally a second joining profile P2 (not shown here in detail), which corresponds to the first joining profile P1. In the present exemplary embodiment the second joining profile P2 corresponds to the cross section of a flat plate. The interconnected joining profiles P1, P2 of adjacent segments Sg1 to Sg8 form the joining zones F1 to F8.

The first segment Sg1 shown in FIG. 7 can be interconnected to structurally identical further segments Sg2 to Sg8, preferably by means of screwed connections (not shown here in greater detail). For this purpose, threaded bushings can be provided in the region of the second joining profile P2, for example. It is also possible to adhesively bond the segments Sg1 to Sg8 to one another in addition to the aforementioned screwed connections.

Although the stirring body 1 has a hyperboloid-like form in the figures, it may also be that the stirring body 1 is formed for example in the manner of a truncated cone.

The device according to the invention can be operated with a significantly improved efficiency. The reason for this is essentially the arrangement of the apertures D1 to D8 in such a way that the geometric centers of gravity S1 to S8 thereof are disposed in the vicinity of an adjacent transport rib T1 to T8. The combination of an aperture D1 to D8 with a transport rib T1 to T8 of which the height increases continuously from the peripheral edge UR to the aperture D1 to D8 causes an additional increase in the efficiency. Lastly, the inclination of the transport ribs T1 to T8 towards the adjacent aperture areas contributes to a further efficiency increase.

LIST OF REFERENCE SIGNS 1 stirring body
2 connector piece
U underside
O upper side
D1 to D8 aperture
E1 first end
E2 second end
F1 to F8 joining zone
Fa1 first joining portion
Fa2 second joining portion
H1 minimum height
H2 maximum height
K1 to K8 crest line
M1, M2, M8 centerline
P1 first joining profile
P2 second joining profile
S1 to S8 centre of gravity
Sg1 to Sg8 segment
T1 to T8 transport rib
UR peripheral edge
W path
$\alpha$ angle

The invention claimed is:

1. A device for circulating a liquid received in a container comprising:
- a hyperboloid or truncated cone stirring body mounted on a vertical shaft,
- wherein a plurality of transport ribs extending from a peripheral edge in a direction of the shaft is provided on an upper side of the stirring body,
- wherein a centerline between two adjacent transport ribs is defined by points of equal minimum distance from each crest line of the two adjacent transport ribs,
- wherein only one aperture is provided in the stirring body between the two adjacent transport ribs,
- wherein an aperture area delimited by an edge of the aperture has a geometric centre of gravity,
- wherein the geometric centre of gravity of the aperture area is disposed in a region between the centerline and the crest line of one of the two adjacent transport ribs,
- wherein the aperture area extends substantially in a radial direction and has a first end in a vicinity of the shaft and a second end directed toward the peripheral edge,
- wherein the aperture area is delimited on one of long sides by one of the plurality of transport ribs, and
- wherein the aperture area has a width at the second end greater than a width at the first end.

2. The device according to claim 1, wherein the transport ribs each have a curvature, which is directed towards the shaft in the radial direction.

3. The device according to claim 1, wherein a height of the plurality of transport ribs increases from the peripheral edge to the first end of the aperture area.

4. The device according to claim 1, wherein a height of the plurality of transport ribs decreases from the first end of the aperture area in the direction of the shaft.

5. The device according to claim 1, wherein the plurality of transport ribs is inclined at an angle $\alpha$ relative to the aperture area of an adjacent or a bordering aperture.

6. The device according to claim 1, wherein a ratio between a lateral area of the stirring body and an overall aperture area of all apertures lies in a range from 10:1 to 10:2.

7. The device according to claim 1, wherein geometric centers of gravity of the aperture areas are distanced from one another at a same angle.

8. The device according to claim 1, wherein a symmetry of the stirring body is defined by an n-fold axis of rotation, wherein n is an integer from 6 to 12.

9. The device according to claim 1, wherein the stirring body is formed from structurally identical segments, which are interconnected along joining zones extending from the peripheral edge to a centrally arranged connector piece.

* * * * *